United States Patent [19]

Tracton et al.

[11] Patent Number: 4,517,240

[45] Date of Patent: May 14, 1985

[54] PROCESS FOR PREPARING FIBERBOARD

[75] Inventors: Arthur A. Tracton, Somerville, N.J.; John N. Guidice, Charlotte, N.C.

[73] Assignee: National Starch and Chemical Corporation, Bridgewater, N.J.

[21] Appl. No.: 657,286

[22] Filed: Oct. 3, 1984

Related U.S. Application Data

[63] Continuation-in-part of Ser. No. 350,947, Feb. 22, 1982, abandoned.

[51] Int. Cl.[3] ..... B32B 23/00; B05D 3/02

[52] U.S. Cl. ..... 428/326; 156/62.2; 427/370; 427/387; 427/393; 428/327

[58] Field of Search ..... 427/387, 392, 370, 393; 428/326, 452, 402, 327, 403, 405, 452; 156/62.2

[56] References Cited

U.S. PATENT DOCUMENTS

| | | | |
|---|---|---|---|
| 3,505,377 | 4/1970 | Morehouse | 556/445 |
| 4,018,647 | 4/1977 | Wietsman | 162/168.1 |
| 4,063,995 | 12/1977 | Grossman | 376/272 |
| 4,076,672 | 2/1978 | Huber et al. | 428/266 X |
| 4,225,456 | 9/1980 | Schmidt | 252/321 |
| 4,238,438 | 12/1980 | Laughinghouse | 264/119 |
| 4,293,611 | 10/1981 | Martin | 427/387 X |
| 4,447,498 | 5/1984 | Fink et al. | 428/447 |

*Primary Examiner*—Thurman K. Page

*Attorney, Agent, or Firm*—Edwin M. Szala; Margaret B. Kelley

[57] ABSTRACT

In a one-step process for preparing fiberboard, an aqueous treating composition comprising about 3–20%, preferably 5–15%, by weight of an acrylic or vinyl acetate emulsion or solution polymer and about 0.05 to 3.0% by weight of a fluid, water-soluble organosilicone copolymer of dimethylpolysiloxane-polyalkylene ether is applied to the fiber panel prior to final compression. The treating composition acts both as a platen release agent during compression and a tempering agent for imparting water-resistance.

20 Claims, No Drawings

PROCESS FOR PREPARING FIBERBOARD

This application is a continuation-in-part of U.S. Ser. No. 350,947 filed Feb. 22, 1982, now abandoned.

BACKGROUND OF INVENTION

This invention relates to an improved process for preparing fiberboard having water resistance and improved releasability and to the treated fiberboard thus produced.

Fiberboards (sometimes called pressed boards or hardboards) are boards manufactured from cellulosic fibers interfelted, preferably with a binder material, to produce an initial adhesive bond among the fibers. In a typical preparation procedure, the wet interfelted panels are shaped and cut to the approximate desired dimensions, (ordinarily to form a semi-hard board) and transferred to a drying and baking oven wherein the remaining moisture is evaporated and the boards are baked to set the binders therein. To allow the fiber panel to be released from the platens in the press for subsequent compression to size, the panel is typically treated, prior to drying and compression, with a hydrocarbon resin. An additional treatment of the basic board for water resistance (tempering) is often carried out with various combinations of polymeric materials and drying oils. Thus, the compressed, hot board may be immersed in a bath of a siccative material such as a drying oil or drying oil blend of oxidized resins so that the surface and edges of the board are impregnated with up to 6% of the oil. The treating oil may also be applied by spraying or roll coating. The impregnated board is then baked at high temperature to oxidize (polymerize) the drying oil to a tough, insoluble form, to yield the tempered fiberboard in final form. The fiberboard exhibits greatly improved physical properties such as resistance to moisture, strength, hardness; possesses paintability and machinability, and is mostly used in applications in which it is likely to be exposed to external conditions of weather or dampness.

There is therefore a need for a one-step process for preparing fiberboard wherein the separate applications of hydrocarbon resins for release properties and of drying oil for water resistance are replaced by a one-step application of an aqueous composition which will provide a fiberboard having water resistance and releasability equal to or better than the tempered fiberboard of the prior art.

SUMMARY OF THE INVENTION

The present invention provides a one-step process for simultaneously compressing and tempering a fiberboard panel, which comprises the step of applying to the panel prior to compression thereof an effective amount of an aqueous treating composition which comprises about 3–20% by weight of an acrylic or vinyl acetate emulsion polymer or solution polymer and about 0.05 to 3.0% by weight of a fluid, water-soluble organosilicone copolymer of dimethylpolysiloxane and a polyoxyalkylene ether wherein the alkylene moiety is ethylene or propylene or mixtures thereof, characterized in that the treating composition acts both as a platen release agent during the compression and as a tempering agent for imparting water-resistance. The amount applied should be sufficient to form a uniform coating with application weights (on a dry basis) ranging from about 1–3 g./sq. ft.

The one-step process herein represents an improvement over prior art techniques by replacing two organic-based resin compositions with one aqueous-based composition which imparts both satisfactory platen release and water and moisture resistance without major alteration of the process line currently in use. It is an added feature that the use of the aqueous treating compositions described herein eliminates the need for drying oils and organic solvents.

DESCRIPTION OF THE PREFERRED EMBODIMENTS

The treating composition is an aqueous mixture of an acrylic or vinyl acetate polymer emulsion or solution and a water-soluble organosilicone polymer. An acrylic polymer as defined herein is a homo- or copolymer derived from at least one acrylic monomer. Representative acrylic monomers include, for example, acrylic acid, methacrylic acid and their $C_1$–$C_8$ esters such as methyl, ethyl, butyl or octyl acrylate or methacrylate. Examples of suitable acrylic polymers are polyacrylic acid, polymethacrylic acid, and acrylic acid/alkyl acrylate, styrene/alkyl acrylate, styrene/alkyl acrylate/N-alkylolacrylamide, alkyl methacrylate/alkyl acrylate/acrylic or methacrylic acid, and styrene/alkyl acrylate/N-alkylolacrylamide/acrylic acid or methacrylic polymers. Vinyl acetate polymers as defined herein are polyvinyl acetate and copolymers of vinyl acetate with acrylic monomers, ethylene, or other copolymerizable monomers. Mixtures of vinyl acetate and acrylic polymers may be employed, if desired. The preferred polymers are polyvinyl acetate, vinyl acetate/butyl acrylate, vinyl acetate/N-methylolacrylamide, styrene/butyl acrylate/N-methylolacrylamide, butyl acrylate/methyl methacrylate/hydroxyethyl acrylate/acrylic acid, styrene/butyl acrylate/N-methylolacrylamide/methacrylic acid, and butyl acrylate/methyl methacrylate/acrylic acid.

The treating compositions herein preferably employ the acrylic or vinyl acetate polymers in aqueous emulsion form but some polymers may be employed in aqueous solution form as would be apparent to one skilled in the art. The solids contents of the polymer emulsion or solution as used in formulating the aqueous treatment compositions will typically range from about 40 to 60% solids by weight.

The organosilicone polymers useful herein are fluid, water-soluble copolymers of dimethylpolysiloxane-polyoxyalkylene ether wherein the alkylene moiety is ethylene or propylene or mixtures thereof. Examples of such water-soluble polymeric siloxanes available commercially are products designated Silwet TM copolymers L-7600, L-7002, L-7001, L-720, L-721 and L-722 sold by Union Carbide Corporation and Silicone Q4-3667 sold by Dow Corning Corp.

The L-7600, L-7002, and L-7001 Silwet copolymers are non-hydrolyzable surfactants containing Si-O-C bonds and have the general formula:

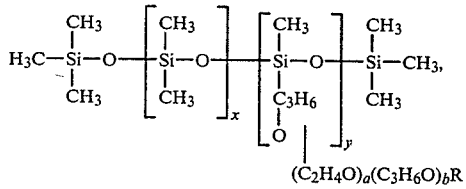

-continued where R is H or a lower where R is H or a lower alkyl radical, x is at least 40, y is at least 3, and the sum of a+b is such that the oxyethylene and oxypropylene blocks have a molecular weight of at least 1500. The Silwet L-7001 and 7002 copolymers are further described in U.S. Pat. No. 3,505,377 issued Apr. 7, 1970 to E. L. Morehouse wherein R is identified as a $C_1$–$C_{10}$ monovalent hydrocarbon group.

The L-720, L-721, and L-722 Silwet copolymers are hydrolyzable surfactants containing Si-O-C bonds and have the general formula:

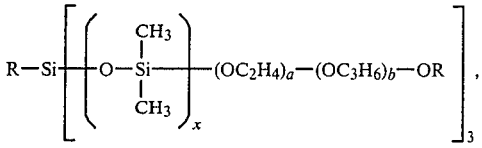

where R is a lower alkyl radical and x is a number sufficient to provide 15–35% by weight of siloxane blocks, and the sum of a+b is a number sufficient to provide 65–85% by weight of oxyethylene and oxypropylene blocks. The Silwet 720 copolymers are further described in U.S. Pat. No. 3,980,688 issued Sept. 14, 1976 to C. J. Litteral et al.

The Silicone Q4-3667 copolymer is a primary hydroxyl functional polydimethylsiloxanepolyoxyethylene copolymer with a linear structure and fuctionality only on the ends of the polymer chain.

Of the polymeric siloxanes useful herein the nonhydrolyzable are preferred. The hydrolyzable copolymers yield acceptable results and can be used where storage stability is not a factor and the treating composition is used within a relatively short period.

The relative amounts of the acrylic or vinyl acetate polymer and the water-soluble polymeric siloxane present in the treating composition herein will depend on several factors including, for example, the types of polymer selected and the degree of release and water resistance desired in the fiberboard product.

In most instances the composition will be formulated to contain about 3–20%, preferably 5–15%, by weight of an acrylic or vinyl acetate emulsion or solution polymer and about 0.05 to 3.0%, preferably 0.3 to 1.0%, by weight of the water-soluble polymeric siloxanes defined above. The compositions applied to the fiber web must have viscosity which is operable for the type of application being used, (e.g., spraying, roll coating, etc.). Typically the range for most application will be about 50 to 500 cps., preferably 100 to 200 cps. To obtain a viscosity within this range it may be necessary at times to dilute the final treating composition with water while keeping the acrylic or vinyl acetate polymer and the polymeric organosilicone substantially within the above-stated ranges. The amount applied should be effective to coat the web and impart water-resistance and platen release. If the composition is too thin, it will soak into the mat and the surface will not be effectively and uniformly covered. If the composition is too thick, the coating may build-up on the platen interfering with release.

Optional ingredients may be added to the treating compositions, if desired, to provide them with special properties as may be necessary or desired. Included among such ingredients are polyvinyl alcohol to aid in roller coating and to improve flow control in applying the composition. Urea-formaldehyde, methylol urea or ethylene urea thermosetting resins may be added to obtain improved water resistance. Catalysts such as ammonium chloride or citric acid may also be added when such thermosetting resins are used. Glycerol can be used as a miscibility aid and to lower viscosity. Thickening agents such as carboxymethyl cellulose, hydroxymethyl cellulose or hydroxyethyl cellulose may be added to raise the viscosity. Defoamers aid in the addition of the organosilicone polymer and other ingredients during the preparation of the composition. A particularly suitable defoamer is Colloid 600, sold by Colloids Inc. of Newark, N.J. Water-soluble dyes are often used in obtaining a uniform color for those fiberboard panels having a fiber finish which varies in color from batch to batch. Ordinarily, the treating compositions will not contain more than about 10% of optional ingredients in total.

The term fiberboard as used herein is meant to include not only hardboards, usually defined as having a specific gravity of about 1 or greater or having a density of at least about 55 lb./cu. ft., but also medium density fiberboards (semi-hardboard), usually having a density range of about 5–50 lb./cu. ft., and low density fiberboards, with a density of about 9–25 lb./cu. ft. Preferred herein are the semi-hardboards and hardboards, as these are the fiberboards most commonly encountered for exterior use for which the present process is particularly advantageous.

The treating compositions herein are useful in the four basic processes for preparing fiberboard, i.e., a wet process, semiwet process, dry process, and semidry process which are described in Encyclopedia of Polymer Science and Technology, Vol. 4, pp. 84–89, 1966 (Interscience Publishers, John Wiley & Sons, Inc., New York). They are particularly suitable for the wet or semiwet processes. In the wet process the wet fiber mat is conveyed into the hot press. In the semiwet process the mat is hot wet pressed but is first completely dried to a low moisture content in a low density form and then hot pressed to the final density. The compositions are applied to the fiber panel (optionally containing conventional binder) after it has been shaped and cut to the desired dimensions and oven-treated in the dry, semidry, or semiwet processes, but before it has been compressed to final dimensions. The composition described above is applied to the formed panel by any suitable technique such as by spraying or by metering the composition onto the web by a roll, as by, e.g., wipe rolling, direct roll coating or reverse roll coating.

In preparing the treating composition it has been found convenient to first prepare a concentrate of the acrylic or vinyl acetate polymer emulsion or solution and the polymeric organosilicone together with the desired optional ingredients. The concentrate is thereafter diluted with water to bring the polymeric components within the ranges specified above and to provide the desired viscosity. For example, a typical preparation of the treating composition would first involve mixing from about 85 to 99.6 parts of the acrylic or vinyl acetate polymer emulsion with from 15 to 0.4 parts of polymeric organosilicone in an amount to equal 100 parts of concentrate. If any optional ingredients are desired, they may be conveniently added to the formed concentrate. The concentrate thereafter is diluted with water, for example, 100 parts of concentrate is diluted with from about 200 to 700 parts of water.

The amount of treating composition to be applied to the fiberboard will vary depending on a number of factors including, for example, the concentration of the polymer emulsion (or polymer solution) and the organosilicone in the treating composition, the porosity of the fiberboard surface, the degree of water resistance desired, and the like. In view of the large number of factors it can be understood that the amount of treating composition which may be applied can vary within a wide range. In most applications, about 0.21 to 0.63 ounces (6 to 18 grams) of the treating composition should be applied per one square foot of fiberboard surface. Practitioners in the art will have no difficulty in determining the amount necessary in individual cases.

After the application of the composition to the web, the panel is compressed in a hot platen press to form the fiberboard of necessary density. It may be dried in a drying and baking oven prior to compression. The thus treated panel is characterized by its ready release from the platens of the press, which releasability is ordinarily equivalent to or improved over the hydrocarbon resin treated panels, as determined by the platen and tape tests described below. In addition, the finished fiberboard herein will have a water resistance comparable to fiberboard prepared by the two-step process of the prior art.

The following examples illustrate several embodiments of the present invention. All parts and percentages are given by weight and all temperatures in degrees Celcius unless otherwise noted. The solids content of the polymer emulsions used in the examples ranged from about 45–55% solids by weight.

In the examples below, the following test procedures were used to evaluate the properties of the treated fiberboard.

Platen Test:

A treated fiberboard panel prior to compression is introduced into a small press between two platens. The panel is compressed and the release properties are observed by noting whether, when the platens are removed, the fiberboard adheres to the platens. The absence of any adherence is rated as "Excellent" (E) while the greatest amount of adherence is rated as Poor (P). "Good" (G) and "Fair" (F) are intermediary ratings. For purposes herein, a rating of at least "Good" is acceptable for the treated fiberboard. Unless otherwise noted standard conditions for the platen test were 204° C. (400° F.) for 3 minutes using 35,000 psi.

Tape Test:

A piece (approx. 1"×4") of pressure-sensitive adhesive tape (Scotch Brand No. 600 tape by 3M) is adhered with finger pressure to the treated final fiberboard and then pulled off. A "Satisfactory" (S) rating indicates that essentially no fiber adhered to the tape, while "Failure" (F) indicates adherence of many fibers. Thus, a "Satisfactory" rating signifies acceptable release properties for the treating composition herein.

Paintability Test:

A pigmented coating primer (i.e., 50 PVC vinyl acetate base) was brushed onto the surface of the treated fiberboard, and the sample was air-dried overnight. A portion of the surface was scribed using an Erichsen Crosshatch Cutter Model No. GE-2951-4 (available from Gardiner Division of Pacific Scientific of Betheseda, Md.) or a like cutter. The tape adhesive test was carried out on the scribed and unscribed surface. The numerical results indicate the relative % of the painted surface remaining after the tape is removed, with 10 indicating 100% remaining and 0 indicating nothing remaining.

Water Resistance Test:

5-Minute Test: Several drops of water are separately placed onto the fiberboard. After five minutes, if the water drops remain as distinct beads (i.e., the contact angle of the water does not change), the board has the best water resistance and is given a 10 (highest) rating. As the water drop spreads and the water penetrates more into the board the rating decreases, with the lowest level of the scale being 1. For purposes herein, a rating of at least 7 indicates acceptable water resistance for the treated fiberboard.

2-Hour Test: The test was carried out as above only the water was allowed to remain on the fiberboard for 2 hrs. before the evaluation. A rating of "Excellent" (E), "Good" (G) , "Fair" (F) and "Poor" (P) is used. This more severe test is closer to the industry test for evaluating water-resistance, which involves soaking the entire sample. A rating of fair or above is considered acceptable. The term "recovery" refers to fiber puffing with slight to moderate puffing being considered acceptable.

EXAMPLE 1

Three treating compositions were prepared by mixing 4822 g. of an emulsion containing the polymers listed in Table I with 4.3 g. of a defoamer (Colloid 600), 87.0 g. of Silicone Q4-3667, and 87.0 g. of glycerol. The silicone copolymer (described previously) had weight average and number average molecular weights of $2.38\times10^3$ and $1.46\times10^3$, respectively). One hundred parts of each mixture was diluted with 500 parts of water to form treating compositions which contained about 8.3% vinyl acetate polymer and 0.3% silicone copolymer.

A treated fiberboard composed of interfelted lignocellulosic fibers was prepared by the process herein by spraying each of the formulations described below on all surfaces of a preformed hardboard panel (15.2 cm.×15.2 cm×1.3 cm) prior to compression. Six grams of the treating composition was used with each preformed panel. The treated panels were then heated in an oven at about 150° C. for 15 minutes and thereafter pressed, without cooling, at about 205° C. (400° F.) at 35,000 psi for 3 minutes. Each fiberboard panel was evaluated for platen release and water resistance properties. The results are given in Table I.

TABLE I

| Treatment Composition | | | Test Results | | |
|---|---|---|---|---|---|
| Emulsion Polymer (monomer, molar ratio, Tg °C.) | Viscosity (cps.) | Color | Platen Release | Tape Test | 5 Min. Water Resistance |
| Polyvinyl acetate (VA +30°) | 70 | very dark | E | S | 10 |
| Vinyl acetate/Butyl | 50 | med. dark* | E | S | 7 |

TABLE I-continued

| Treatment Composition | | | Test Results | | |
|---|---|---|---|---|---|
| Emulsion Polymer (monomer, molar ratio, Tg °C.) | Viscosity (cps.) | Color | Platen Release | Tape Test | 5 Min. Water Resistance |
| acrylate (VA/BA - 80/20 +7°) Vinyl acetate/ N—Methylolacrylamide (VA/NMA - 96/4 +29°) | 50 | light | E | S | 9 |

*When 1 drop of brown or black dye was added to 50 g of the composition, the resulting fiberboard was darker and more uniform than a control panel which was tempered using a hydrocarbon resin and drying oil.

The test results indicate that the vinyl acetate polymer and copolymers, which ranged in Tg from +7° to +30° C., were acceptable when used together with the silicone copolymer for treating the hardboard.

EXAMPLE 2

This example illustrates the effect of using increasing amounts of silicone copolymer on the properties of the treated hardboard.

The compositions were prepared as in Example 1 except that the amount of silicone copolymer in the composition ranged from 0.08 to 0.3%. The amount of glycerol was also increased. The amount of polyvinyl acetate was 8.3%. The hardboards were treated as before using Formulations A-D and a control formulation containing no silicone copolymer. The results are given in Table II.

TABLE II

| Ingredients (parts) | Control | Formulation* A | B | C | D |
|---|---|---|---|---|---|
| Polyvinyl Acetate (VA) Polymer Emulsion | 4822 | 4822 | 4822 | 4822 | 4822 |
| Colloid 600 (defoamer) | 4.3 | 4.3 | 4.3 | 4.3 | 4.3 |
| Silicone Q4-3667 | 0 | 22 | 44 | 65 | 87 |
| Glycerol | 22 | 22 | 44 | 65 | 87 |
| Platen Release Test: | P | G | G | E | E |
| Tape Adhesion Test: | F | S | S | S | S |
| 5-Min. Water Resistance Test: | 1 | 9 | 9 | 10 | 10 |

*One hundred parts of each formulation was diluted with 500 parts of water to form the treating composition.

It can be seen that increasing amounts of silicone copolymer improved the properties of the treated fiberboard. Formulation D had the best uniform sheen of all the formulations.

A top-coat pigmented formulation was applied to the hardboard made with formulation D and allowed to dry overnight. Evaluation by the tape test showed that the adhesion of the top coat to the treated fiberboard was excellent.

EXAMPLE 3 (COMPARATIVE)

The process of Example 1 was repeated using two typical long chain hydrocarbon resins designated Picconol A 102 and AA 101 (trademarks of Hercules Inc.) now used as release agents in place of the formlations used in Example 1. The thus treated hardboards exhibited poor water resistance.

EXAMPLE 4

Part A

A formulation was prepared with the following ingredients and found to have the following properties:

| Ingredients (parts): | |
|---|---|
| Silicone Q4-3667 | 87.0 |
| Glycerol | 87.0 |
| Resin EU50* | 227.6 |
| Colloid 600 | 4.3 |
| $NH_4Cl$ aqueous solution (12.5%) | 45.3 |
| Vinyl acetate/Butyl acrylate (VA/BA-80/20) Polymer Emulsion | 4549.1 |
| Viscosity (cps) | 800 |
| pH | 5.0 |

*PROTOREZ EU50 is a cyclic ethylene urea resin sold by Proctor Division of National Starch and Chemical Corp.

In the preparation of the above formulation the silicone and glycerol were mixed together, to which mixture was added the ethylene urea resin, followed by all other ingredients except the polymer, which was added last. The formulation was then diluted with water (1:5) to obtain the proper viscosity (approx. 100 cps) for application to the preformed hardboard panel. It contained 7.6% vinyl acetate polymer and 0.3% silicone copolymer. The formulation was applied by roller application in a semi-commercial operation using the semidry process. The resulting treated hardboard passed the platen and tape test and had good color and smoothness.

Part B

A similar formulation was prepared using a styrene/-butyl acrylate/N-methylolacrylamide polymer (Tg +40° C.) instead of the VA/BA polymer. It was applied by spray application in a semi-commercial operation using the wet process. The resulting treated hardboard was likewise satisfactory.

EXAMPLE 5

This example illustrates the use of three other suitable silicone copolymers at two levels of concentration. The example also illustrates treating compositions with and without glycerol. The hydrolyzable organosilicone, Silwet L-720, is included to show its acceptable performance for use herein. The Silwet polymers were previously described. The weight average and number average molecular weights were $7.27\times10^3$ and $3.31\times10^3$ for Silwet 720, $1.18\times10^4$ and $3.86\times10^3$ for Silwet 7001, and $9.71\times10^3$ and $4.40\times10^3$ for Silwet 7002. Silicone Q4-3667 is included for comparison.

The treating compositions designated A-K were prepared using the ingredients listed in Table III. The amount of vinyl acetate/butyl acrylate (VA/BA) copolymer and silicone copolymer in the compositions is indicated. The procedure of Example 1 was used to prepare treated fiberboards with the compositions. The results of the tests carried out on the resultant fiberboards are given in Table III.

EXAMPLE 6

This example illustrates two treating compositions prepared using aqueous solution polymers. The compositions were prepared by combining and mixing the following ingredients.

TABLE III

| Ingredients (parts) | Formulation* A | B | C | D | E | F | G | H | I | J | K |
|---|---|---|---|---|---|---|---|---|---|---|---|
| VA/BA (80/20) polymer emulsion | 455.0 | 455.0 | 455.0 | 455.0 | 455.0 | 455.0 | 455.0 | 455.0 | 455.0 | 455.0 | 455.0 |
| Silwet L-7001 | 8.7 | 17.4 | 17.4 | — | — | — | — | — | — | — | — |
| Silwet L-7002 | — | — | — | 8.7 | 17.4 | 17.4 | — | — | — | — | — |
| Silwet L-720 | — | — | — | — | — | — | 8.7 | 17.4 | 17.4 | — | — |
| Silicone Q4-3667 | — | — | — | — | — | — | — | — | — | 8.7 | 17.4 |
| Glycerol | 8.7 | 17.4 | — | 8.7 | 17.4 | — | 8.7 | 17.4 | — | 8.7 | 17.4 |
| Resin EU50 | 22.8 | 22.8 | 22.8 | 22.8 | 22.8 | 22.8 | 22.8 | 22.8 | 22.8 | 22.8 | 22.8 |
| Defoamer (Colloid 600) | 0.4 | 0.4 | 0.4 | 0.4 | 0.4 | 0.4 | 0.4 | 0.4 | 0.4 | 0.4 | 0.4 |
| $NH_4Cl$ (12.5% aq. solution) | 4.5 | 4.5 | 4.5 | 4.5 | 4.5 | 4.5 | 4.5 | 4.5 | 4.5 | 4.5 | 4.5 |
| Platen Test | E | E | E | E | E | E | E | E | E | E | E |
| Tape Test | S | S | S | S | S | S | S | S | S | S | S |
| 5 Min. Water Resistance | 8 | 8 | 8 | 8 | 8 | 8 | 8 | 8 | 8 | 8 | 8 |

One hundred parts of each formulation was diluted with 500 parts of water to form the treating composition.

| Ingredients (parts) | Formulations L | M |
|---|---|---|
| Silicone Q4-3667 | 8.7 | 8.7 |
| Glycerol | 8.7 | 8.7 |
| Resin EU50 | 22.8 | 22.8 |
| Colloid 600 | 0.4 | 0.4 |
| $NH_4Cl$ aqueous soln. 12.5% | 4.5 | 4.5 |
| Solution of Polymer A* | 455.0 | — |
| Solution of Polymer B** | — | 455.0 |

*Polymer A comprises butyl acrylate, methyl methacrylate and acrylic acid (BA/MMA/AA) with a solids content of about 48%.
**Polymer B comprises butyl acrylate, methyl methacrylate, hydroxyethyl acrylate and acrylic acid (BA/MMA/HEA/AA) with a solids content of approximately 51%.

Both polymer solutions were adjusted to pH 8–9 using $NH_4OH$ prior to use in the formulations. Both formulations were diluted with water in a 1:3 ratio prior to their use in preparing fiberboard. The amounts of polymer and silicone copolymer were about 11.4% and 0.4%, respectively, based on an average of 50% solids. The viscosity of each treating composition was about 100 cps.

Treated fiberboards were prepared using the two treating compositions as described in the procedure of Example 1. Both compositions yielded acceptable results with respect to water resistance, platen test, and tape test.

EXAMPLE 7

This example studies the effect of varying the platen temperature and/or pressure and press time. The treatment compositions were formulated as in Example 4 except that 4.6% of the polymer and 0.1% of the silicone polymer were used. The test results in Table IV show the use of a vinyl acetate/butyl acrylate emulsion polymer (VA/BA - 80/20 -Tg. of +7° C.) and a styrene/butyl acrylate/N-methylol acrylamide/methacrylic acid emulsion polymer (S/BA/NMA/MA-58.1/38.8/2.9/0.2 -Tg. of +40° C.) with three silicones using the standard treatment conditions. Tables V, VI, VII and VIII show the test results obtained with the above polymers, as well as a styrene/butyl acrylate/N-methylol acrylamide emulsion polymer (S/BA/NMA-78.1/19.6/2.3 -Tg of +56° C., and the Q43667 silicone using varied temperatures, times, and pressures.

TABLE IV

STANDARD CONDITIONS

| Polymer | Silicones Q43667 | L720 | L7001 |
|---|---|---|---|
| VA/BA | | | |
| Platen Release Test | E | E | E |
| Tape Adhesion Test | S | S | S |
| 2 Hr. Water Resistance Test | F | G | G |
| 2 Hr. Recovery | Sl. puff | Sl. puff | Mod. puff |
| S/BA/NMA/MA | | | |
| Platen Release Test | E | E | E |
| Tape Adhesion Test | S | S | S |
| 2 Hr. Water Resistance Test | G | G | G |
| 2 Hr. Recovery | No puff | No puff | Sl. puff |
| S/BA/NMA | | | |
| Platen Release Test | E | — | — |
| Tape Adhesion Test | S | — | — |
| 2 Hr. Water Resistance Test | F | — | — |
| 2 Hr. Recovery | Sl. puff | — | — |

TABLE V

Varied Temperature - Standard Time and Pressure Using Silicone Q43667

| Polymer | VA/BA | S/BA/NMA/MA | S/BA/NMA |
|---|---|---|---|
| Conditions: 204° C. (400° F.) | | | |
| Platen Release Test | E | E | E |
| Tape Adhesion Test | S | S | S |
| 2 Hr. Water Resistance Test | F | G | F |
| 2 Hr. Recovery | Sl. puff | No puff | Sl. puff |
| Conditions: 218° C. (425° F.) All test results were same as for 204° C. test. | | | |
| Conditions: 232° C. (450° F.) The results for the platen release and tape adhesion were the same as for 204° C. test. | | | |
| 2 Hr. Water | G | G | G |

TABLE V-continued

| Varied Temperature - Standard Time and Pressure Using Silicone Q43667 | | | |
|---|---|---|---|
| Polymer | VA/BA | S/BA/NMA/MA | S/BA/NMA |
| Resistance Test | | | |
| 2 Hr. Recovery | Sl. puff | No puff | No puff |

TABLE VI

| Varied Press Time - Standard Temperature and Pressure Using Silicone Q43667 | | | |
|---|---|---|---|
| Polymer | VA/BA | S/BA/NMA/MA | S/BA/NMA |
| Conditions: 3 min. | | | |
| Platen Release Test | E | E | E |
| Tape Adhesion Test | S | S | S |
| 2 Hr. Water Resistance Test | F | E | E |
| 2 Hr. Recovery | Mod. | No puff | No puff |
| Conditions: 6 min. | | | |
| All test results were the same as for the 3 min. press time. | | | |
| Conditions: 9 min. | | | |
| All test results were the same as for the 6 min. press time. | | | |

TABLE VII

| Varied Pressure - Standard Temperature and press Time Using Silicone Q43667 | | | |
|---|---|---|---|
| Polymer | VA/BA | S/BA/NMA/MA | S/BA/NMA |
| Conditions: 50,00 psi. | | | |
| Platen Release Test | E | E | E |
| Tape Adhesion Test | S | S | S |
| 2 Hr. Water Resistance Test | F | G | G |
| 2 Hr. Recovery | Mod. puff | No puff | V. sl. puff |

TABLE VIII

| Varied Pressure and Temperature - Standard Press Time Using Silicone Q43667 | | | |
|---|---|---|---|
| Polymer | VA/BA | S/BA/NMA/MA | S/BA/NMA |
| Conditions: 50,000 psi. and 218° C. (425° F.) | | | |
| Platen Release Test | E | E | E |
| Tape Adhesion Test | S | S | S |
| 2 Hr. Water Resistance Test | F | G | G |
| 2 Hr. Recovery | Mod. puff | No puff | No puff |

The results show that the platen release and tape adhesion test results were excellent under all application conditions for all the polymers. Using the standard conditions, the water resistance and recovery results varied for the less thermoplastic polymer (S/BA/NMA/MA) depending on the silicone used. When used with the same silicone resin (Q43667), the various polymers showed differences in water resistance and recovery. However, under the appropriate application conditions all performed satisfactorily, with the less thermoplastic polymers being better. For example, the S/BA/NMA/MA and S/BA/NMA polymers both showed excellent water resistance and recovery when applied at 204° C. (400° F.)/35,000 psi whether the press time was 3, 6, or 9 minutes.

EXAMPLE 8

This example studies the adhesion of the pigmented coatings to the coated pressed hardboards. The polymers of Example 7 and the Q43667 resin were used in the same amounts. The L720 and L7001 silicone resins were used in the same amount as the Q43667 resin. The compositions were applied to the board as before using the indicated application conditions. The release-coated pressed board was then brush coated with the primer and air dried overnight. Tape adhesion to the painted surface was tested on both the unscribed and scribed board. The scribed board had five lines cut into the surface in a cross hatch. The results are given in Tables IX and X.

TABLE IX

| Unscribed/Scribed Adhesion Ratings (Varied Application Conditions) | | | |
|---|---|---|---|
| Q43667 at | VA/BA | S/BA/NMA/MA | S/BA/NMA |
| 204° C.(400° F.) - Std. Time and Pressure | 10/10 | 510/8 | 10/4 |
| 218° C. (425° F.) - Std. Time and Pressure | 10/10 | 10/7 | 9/2 |
| 232° C. (450° F.) - Std. Time and Pressure | 10/10 | 10/6 | 7/2 |
| 3 min. - Std. Temperature and Pressure | 10/7 | 10/6 | 10/5 |
| 6 min. - Std. Temperature and Pressure | 10/10 | 10/8 | 10/7 |
| 9 min. - Std. Temperature and Pressure | 10/10 | 10/8 | 10/6 |
| 204° C. (400° F.)/50,000 psi - Std. Time | 10/4 | 10/4 | 9/2 |
| 218° C. (425° F.)/50,000 psi - Std. Time | 10/10 | 10/8 | 10/0 |

TABLE X

| Unscribed/Scribed Adhesion Ratings (Standard Application Conditions) | | | |
|---|---|---|---|
| | Q43667 | L720 | L7001 |
| VA/BA | 10/10 | 10/6 | 10/10 |
| S/BA/NMA/MA | 10/8 | 10/8 | 10/10 |

The results show that unscribed adhesion test results were excellent with most of the polymers having a 10 for all application conditions. The scribed adhesion (a more severe test) was good to excellent for most of the polymers and resins under the appropriate applications conditions. The poor adhesion of the high Tg S/BA/NMA polymer can be attributed more to the brittle nature of the polymer film than poor adhesion of the pigmented coating to the hardboard. Unlike conventional platen release agents such as waxes, the platen release compositions herein provide a surface which can be painted with resultant good adhesion.

EXAMPLE 9

This example demonstrates that suitable treating compositions can be prepared without the use of Resin EU 50 (present in the compositions of Examples 4–8). The compositions were formulated as in Example 7 using the same polymers with Silicone resin Q43667. Standard application conditions were used. The test results are shown in Table XI.

TABLE XI

| | VA/BA | S/BA/NMA/MA | S/BA/NMA |
|---|---|---|---|
| Platen Release Test | E | E | E |
| Tape Adhesion Test | S | S | S |

TABLE XI-continued

| | VA/BA | S/BA/NMA/MA | S/BA/NMA |
|---|---|---|---|
| 2 Hr. Water Resistance Test | F | G | G |
| 2 Hr. Recovery | Sl. puff | V. sl. puff | V. sl. puff |

The compositions without Resin EU50 all showed excellent platen release and tape adhesion.

Now that the preferred embodiments of the invention have been described in detail, various modifications and improvements thereon will become readily apparent to the practitioner. The spirit and scope of the invention are to be limited only by the following claims, and not by the foregoing specification.

What is claimed is:

1. A one-step process for simultaneously compressing and tempering a fiberboard panel, which comprises the step of applying to the panel prior to compression thereof an aqueous treating composition which comprises about 3–20% by weight of an acrylic or vinyl acetate emulsion or solution polymer and about 0.05–3.0% by weight of a fluid, water-soluble organosilicone copolymer of dimethylpolysiloxane-polyoxyalkylene ether wherein the alkylene moiety is ethylene or propylene or mixtures thereof, characterized in that the treating composition acts both as a platen release agent during compression and as a tempering agent for imparting water-resistance.

2. The process of claim 1, wherein the aqueous treating composition comprises about 5–15% of the acrylic or vinyl acetate polymer.

3. The process of claim 2, wherein the treating composition comprises polymers of vinyl acetate alone or with an alkyl acrylate or methacrylate and/or N-alkylolacrylamide or of alkyl acrylate or methacrylate with styrene, N-alkylolacrylamide, and/or acrylic or methacrylic acid.

4. The process of claim 3, wherein the emulsion polymer is polyvinyl acetate, vinyl acetate/butyl acrylate, vinyl acetate/N-methylolacrylamide, styrene/butyl acrylate/N-methylolacrylamide/methacrylic acid, or styrene/butyl acrylate/N-methylolacrylamide.

5. The process of claim 3, wherein the solution polymer is butyl acrylate/methyl methacrylate/acrylic acid or butyl acrylate/methyl methacrylate/hydroxyethyl acrylate/acrylic acid.

6. The process of claim 1, wherein the aqueous coating composition comprises about 0.3–1.0% of the organosilicone copolymer.

7. The process of claim 6, wherein the organosilicone polymer is a hydrolyzable surfactant having the formula

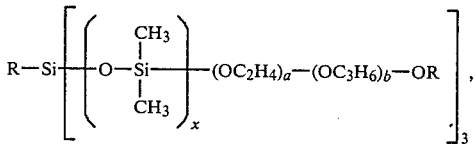

where R is a lower alkyl radical, x is a number sufficient to provide 15–35% by weight of siloxane blocks, and the sum of a+b is a number sufficient to provide 65–85% by weight of oxyethylene and oxypropylene blocks.

8. The process of claim 6, wherein the organosilicone polymer is a nonhydrolyzable surfactant having the formula:

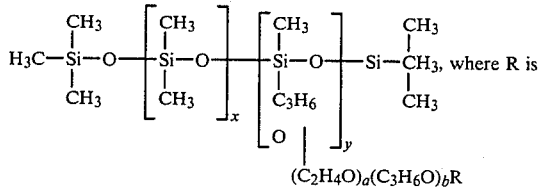

H or a lower alkyl radical, x is at least 40, y is at least 3, and the sum of a+b is such that the oxyethylene and oxypropylene blocks have a molecular weight of at least 1500.

9. The process of claim 6, wherein said organosilicone polymer is a primary hydroxyl functional polydimethylsiloxanepolyoxyethylene copolymer with a linear structure and functionality only on the ends of the polymer chain.

10. The process of claim 1, wherein the aqueous treating composition is applied in an amount of about 6 to 18 grams per one square foot of the panel.

11. The process of claim 10, wherein said treating composition comprises about 5–15% of the acrylic or vinyl acetate emulsion polymer, about 0.3–1.0% of the organosilicone copolymer, and a defoamer, glycerol, thermosetting resin and catalyst therefor.

12. The process of claim 11, wherein the polymer is an emulsion polymer of polyvinyl acetate, vinyl acetate/butyl acrylate, vinyl acetate/N-methylolacrylamide, styrene/butyl acrylate/N-methylolacrylamide/methacrylic acid, or styrene/butyl acrylate/N-methylolacrylamide and the organosilicone polymer is a hydrolyzable surfactant having the formula:

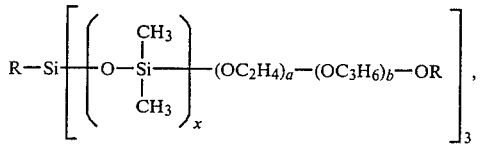

where R is a lower alkyl radical, x is a number sufficient to provide 15–35% by weight of siloxane blocks, and the sum of a+b is a number sufficient to provide 65–85% by weight of oxyethylene and oxypropylene blocks.

13. The process of claim 11, wherein the polymer is an emulsion polymer of polyvinyl acetate, vinyl acetate/butyl acrylate, vinyl acetate/N-methylolacrylamide, styrene/butyl acrylate/N-methylolacrylamide/methacrylic acid, or styrene/butyl acrylate/N-methylolacrylamide and the organosilicone polymer is a nonhydrolyzable surfactant having the formula:

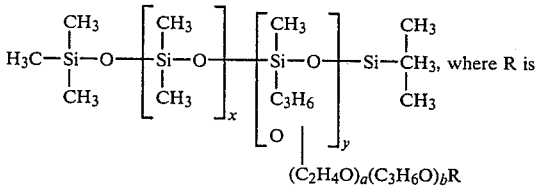

H or a lower alkyl radical, x is at least 40, y is at least 3, and the sum of a+b is such that the oxyethylene and oxypropylene blocks have a molecular weight of at least 1500.

14. The process of claim 11, wherein the polymer is an emulsion polymer of polyvinyl acetate, vinyl acetate/butyl acrylate, vinyl acetate/N-methylolacrylamide, styrene/butyl acrylate/N-methylolacrylamide/methacrylic acid, or styrene/butyl acrylate/N-methylolacrylamide and organosilicone polymer is a primary hydroxyl functional polydimethyl siloxanepolyoxyethylene copolymer with a linear structure and functionality only on the ends of the polymer chain.

15. The process of claim 1, which further comprises the step of partially drying the panel after application and prior to compression.

16. The process of claim 15, wherein said treating composition comprises 5 to 15% by weight of the acrylic or vinyl acetate emulsion polymer and about 0.3 to 1.0% by weight of the organosilicone polymer and said fiberboard is hardboard or semi-hardboard.

17. The process of claim 1, wherein the viscosity of the aqueous treating composition is about 50–500 cps.

18. The process of claim 17, wherein the viscosity of the aqueous treating composition is about 100–200 cps.

19. The fiberboard produced by the process of claim 1.

20. The fiberboard produced by the process of claim 15.

* * * * *